US006657147B2

(12) United States Patent
Tsutsui et al.

(10) Patent No.: US 6,657,147 B2
(45) Date of Patent: Dec. 2, 2003

(54) KEY SWITCH

(75) Inventors: Takaki Tsutsui, Tokyo (JP); Tetsuzou Nakazawa, Tokyo (JP); Takashi Satou, Tokyo (JP); Akio Nakagawa, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/218,643

(22) Filed: Aug. 15, 2002

(65) Prior Publication Data

US 2003/0038021 A1 Feb. 27, 2003

(30) Foreign Application Priority Data

Aug. 22, 2001 (JP) ..... P.2001-250940

(51) Int. Cl.[7] ..... H01H 13/70
(52) U.S. Cl. ..... 200/517; 200/345
(58) Field of Search ..... 200/512, 517, 200/341, 345

(56) References Cited

U.S. PATENT DOCUMENTS 4,560,844 A * 12/1985 Takamura et al. ..... 200/5 A
4,609,791 A * 9/1986 Abbat ..... 200/5 A
4,857,683 A * 8/1989 Maser ..... 200/5 A
4,862,499 A * 8/1989 Jekot et al. ..... 379/368
5,144,103 A * 9/1992 Suwa ..... 200/344
5,655,650 A * 8/1997 Naitou ..... 200/553
6,204,462 B1 * 3/2001 Huang ..... 200/345

* cited by examiner

*Primary Examiner*—Michael Friedhofer
(74) *Attorney, Agent, or Firm*—Whitham, Curtis & Christofferson, PC

(57) ABSTRACT

A key top includes a body part having a first width and a flange formed on a lower end portion of the body part so as to have a second width which is larger than the first width. A click rubber is provided on a bottom face of the body part of the key top. The click rubber is elastically deformable such that the key top is vertically moved between an upper first position and a lower second position. A case is formed with a first chamber and a second chamber. The first chamber has a third width which is larger than the first width but smaller than the second width, for accommodating the body part of the key top therein. The second chamber is continued from the first chamber and has a fourth width which is larger than the second width, for accommodating the flange of the key top and the click rubber therein.

4 Claims, 3 Drawing Sheets

KEY SWITCH

BACKGROUND OF THE INVENTION

The present invention relates to a key switch to be mounted on a controller for a game machine or the like.

A related-art key switch of this type will be described with reference to FIG. 3. In the drawing, a key switch 1 has, in a guide hole 3 which is formed in a case 2 of a controller for a game machine or the like, a key top 4, a click rubber 5 which is formed in a lower part of the key top 4 integrally with the key top 4, a movable contact 6 formed of an electrically conductive body which is provided on a lower face of a head 5*a* of the click rubber, and fixed contacts 8 which are provided on a circuit board 7 positioned below the movable contact 6.

The click rubber 5 is formed in the shape of a bowl, and the moveable contact 6 is provided on an inner face of the head 5*a* of the click rubber 5 as described above in such a manner that the movable contact 6 can be contacted with and detached from the fixed contacts 8 by elastic force of the click rubber 5 that is adapted to be flexed and restored according to motions for striking the key top 4.

Moreover, a circumferential edge of the click rubber 5 at its lower end is bent upwardly to form a recess 9 at a bent part. In the recess 9, a guide wall 10 for defining the guide hole 3 holds the click rubber 5 at its lower end, thereby to fix the click rubber 5 inside the case 2.

In the related-art, there is interposed a slight gap M between the guide wall for defining the guide hole that is formed in the case and the key top that is idly inserted inside the guide wall so as to move vertically.

Accordingly, fatty oils of a user's hand my adhere to the top when the key top is struck, and the fatty oils that have adhered to the key top often fall along a peripheral face of the key top through the gap M to adhere to the click rubber. On such occasions, there will occur in may cases such inconveniences that since the click rubber will be swollen with the fatty oils, the feeling of a click may be lost and a smooth function of key stroke cannot be performed.

SUMMARY OF THE INVENTION

It is therefore an object of the present invention to provide a key switch for preventing fatty oils of a user's hand which have adhered to a key top from directly adhering to a click rubber, so that the function of the click rubber may be fully performed.

In order to achieve the above object, according to the present invention, there is provided a key switch, comprising:

- a key top, including a body part having a first width and a flange formed on a lower end portion of the body part so as to have a second width which is larger than the first width;
- a click rubber, provided on a bottom face of the body part of the key top, the click rubber being elastically deformable such that the key top is vertically moved between an upper first position and a lower second position;
- a case, formed with a first chamber having a third width which is larger than the first width but smaller than the second width, for accommodating the body part of the key top therein, and a second chamber continued from the first chamber and having a fourth width which is larger than the second width, for accommodating the flange of the key top and the click rubber therein.

Consequently, the fatty oils of a user's hand that have adhered to the key top will be received by the flange even though the fatty oils fall down at the stroke of the key top, and the fatty oils will not reach the click rubber in the lower part. Therefore, such drawbacks in the prior art that the click rubber may be swollen with the fatty oils that have adhered to the click rubber resulting in a loss of the feeling of a click and a smooth switching motion cannot be performed. Hence, a malfunction occurring in the key stroke operation will be eliminated. Further, since not only the fatty oils but other foreign substances will not get in direct contact with the click rubber, quality of the key switch will also be improved.

Preferably, an upper face of the flange is abutted against a ceiling part of the second chamber when the key top is placed in the upper first position.

The above described preventive effect for fatty oils or foreign substances can be further enhanced.

Preferably, a recess is formed in a ceiling part of the second chamber. A protrusion is formed on an upper face of the flange. The protrusion is fitted into the recess when the key top is placed in the upper first position.

Since the fatty oils and the foreign substances are accommodated within a recess defined by an outer periphery of the body part and the protrusion, the above described preventive effect for fatty oils or foreign substances can be further enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments according to the present invention will be described with reference to FIGS. 1 and 2.

Figure 1:
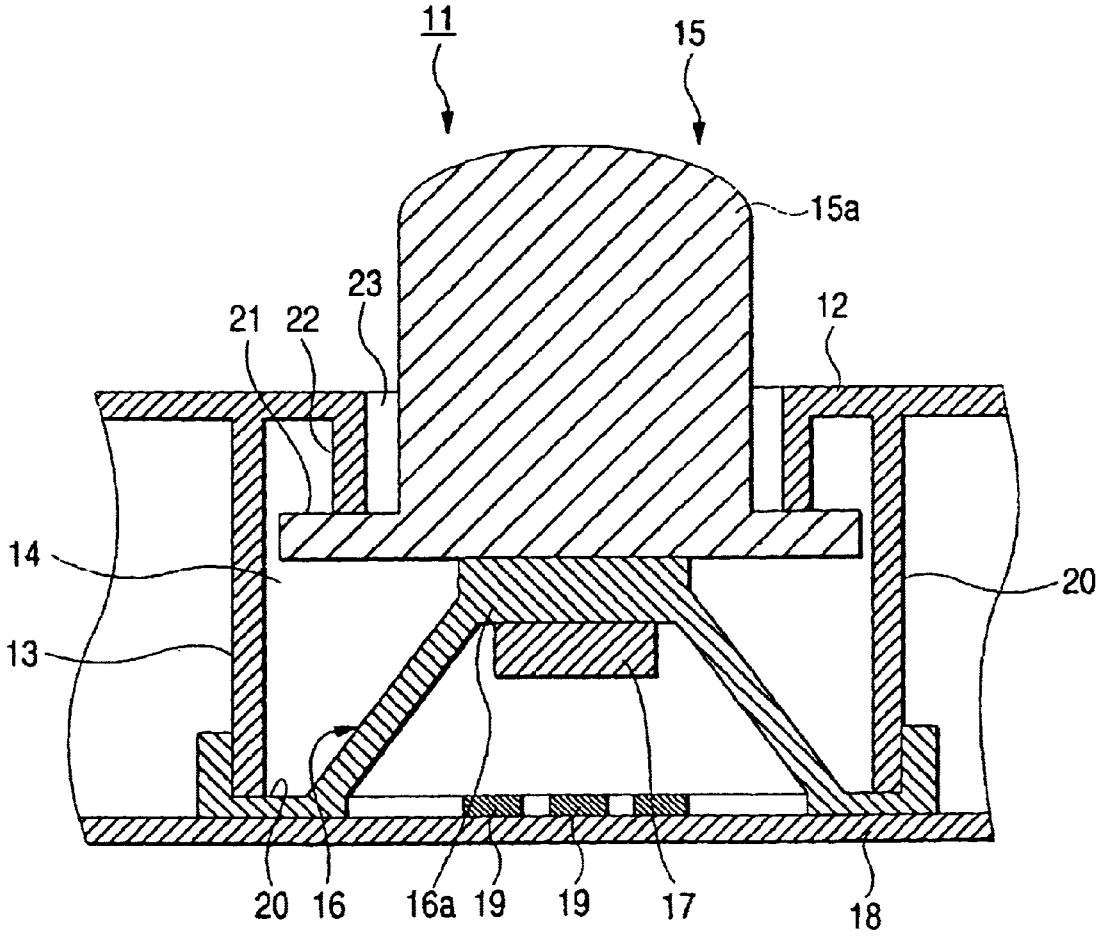
FIG. 1 is a front view in a vertical section of a key switch according to a first embodiment of the present invention.

A key switch 11 according to a first embodiment is shown in FIG. 1. The key switch 11 has, in a large diametered guide hole 14 defined by a large diametered guide wall 13 which is provided in a case 12 of a controller for a game machine or the like, a key top 15, a click rubber 16 which is arranged in a lower part of the key top 15, a movable contact 17 formed of an electrically conductive body which is provided on a lower face of a head 16*a* of the click rubber 16, and fixed contacts 19 which are provided on a circuit board 18 positioned below the movable contact 17.

The click rubber 16 is formed in the shape of a bowl, and the moveable contact 17 is provided on an inner face of the head 16*a* of the click rubber 16 in such a manner that the movable contact 17 can be contacted with and detached from the fixed contacts 19 by elastic force of the click rubber 16 that is adapted to be flexed and restored according to motions for striking the key top 15.

Moreover, a circumferential edge of the click rubber 16 at its lower end is bent in a U-shape to form a recess 20. A lower end face of the large diametered guide wall 13 is abutted against the recess 20 and holds the click rubber 16, thereby to fix the click rubber 16 inside the case 12.

There is further provided, as shown in FIG. 1, a flange 21 outwardly projecting from a circumferential edge of a body part 15*a* of the key top 15 at a lower end thereof. The flange 21 is formed so as to move up and down along an inner peripheral face of the large diametered guide wall 13. Still further, there is provided a small diametered guide wall 22 which is projected downward inside the large diametered guide wall 13 keeping a determined distance therefrom. The small diametered guide wall 22 is formed to have such a length that when the click rubber 16 has been returned to an upper position, the flange 21 can be abutted against a lower end face of the small diametered guide wall 22. The body part 15*a* of the key top 15 is idly inserted into a small diametered guide hole 23, which is defined by the small diametered guide wall 22, so as to move vertically therein.

Incidentally, when the key top 15 is operated for key strokes, the fatty oils of the hand adhering to the surface of the body part 15*a* of the key top 15 will be received by the flange 21 and will not reach the click rubber 16 in the lower part, even though the fatty oils may fall down through a gap between the small diametered guide wall 22 and the body part 15*a* of the key top 15. Thus, the likelyhood that there would occur an event such that the function of the click rubber 16 would be damaged by the fatty oils is greatly reduced.

Furthermore, even in case where the body part 15*a* of the key top 15 exposed out of the case 12 is formed to have a small size so as to vertically move inside the small diametered guide hole 23, the flange 21 provided on the key top 15 is so constructed as to move up and down inside the large diametered guide hole. Therefore, a space for encasing the click rubber 16 can be formed to be sufficiently large, and accordingly, a head of the click rubber 16 as well as the click rubber 16 itself can be formed to have a sufficiently large size. As the results, because a smooth operation of striking the key top 15 can be performed, not only a stable switching motion can be conducted, but a favorable touch of click can be expected. Furthermore, because the flange 21 is so formed as to be abutted against a lower end face of the small diametered guide wall 22, not only the above described fatty oils but other foreign substances will not directly reach the click rubber 16, and accordingly, quality and durability of the key switch will be enhanced.

Figure 2:
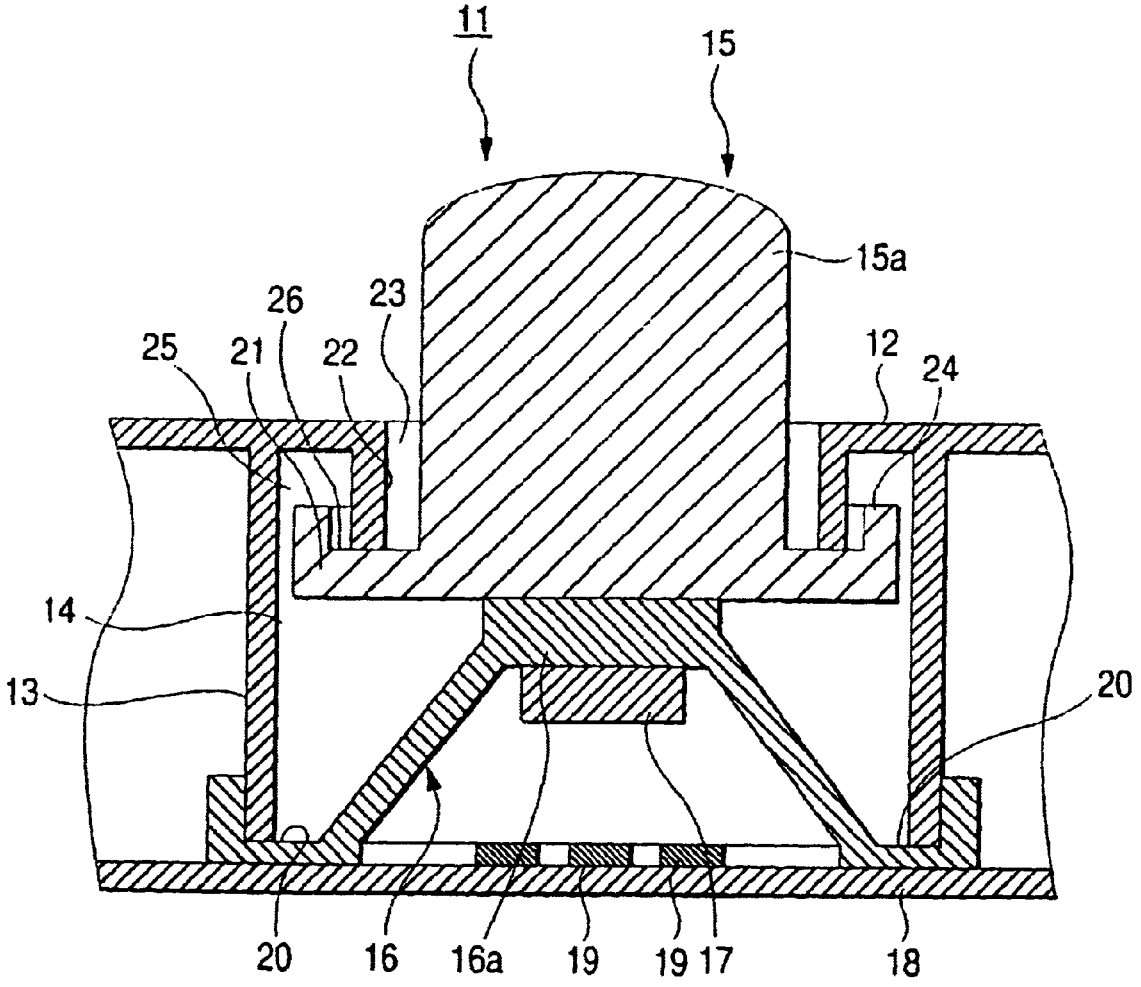
FIG. 2 is a front view in a vertical section of a key switch according to a second embodiment of the present invention.
Figure 3:
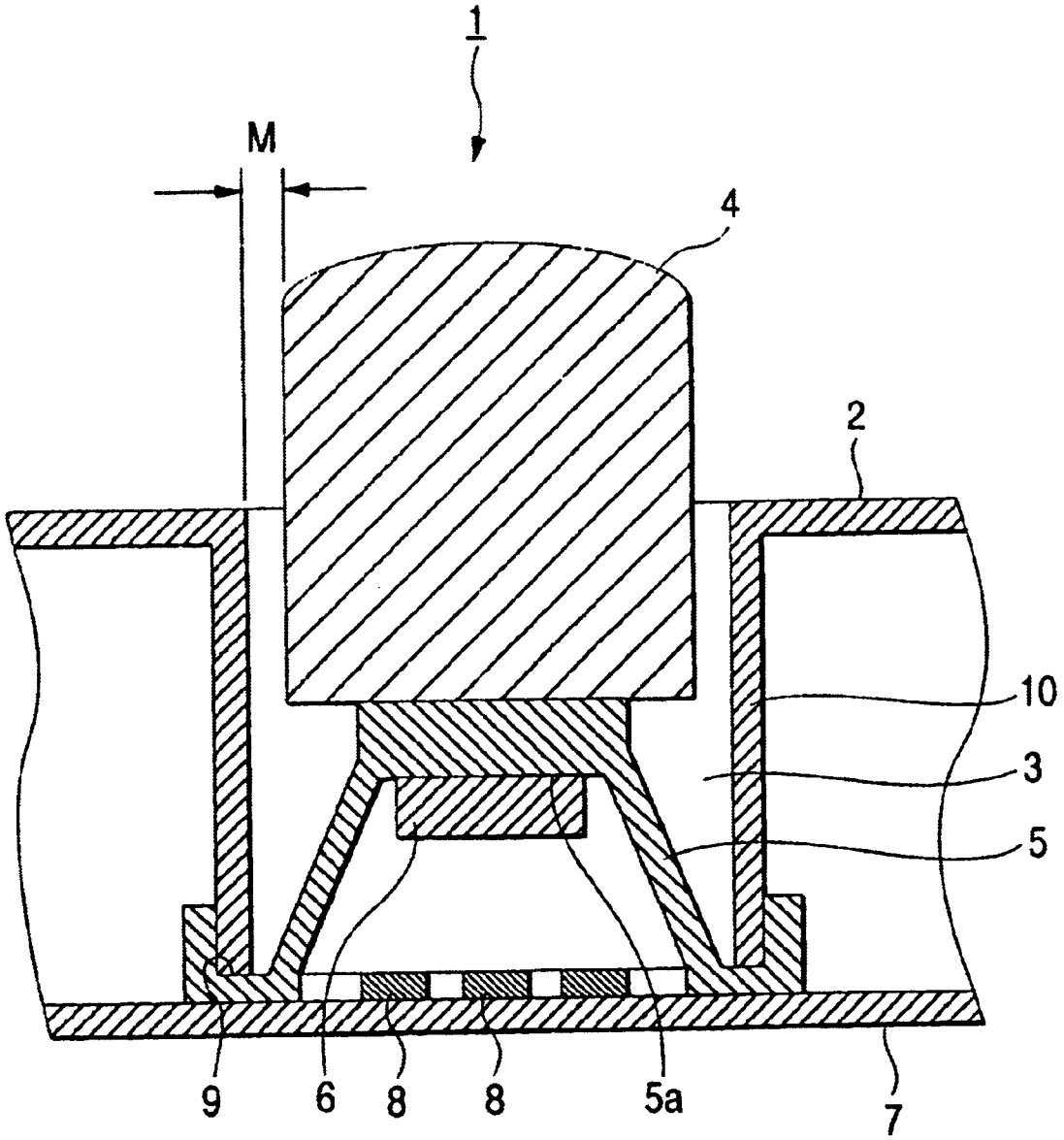
FIG. 3 PRIOR ART
FIG. 3 is a front view in a vertical section of a related-art key switch.

A key switch according to a second embodiment of the invention is shown in FIG. 2. It is to be noted that same constituent elements as shown in FIG. 1 will be denoted with the same reference numerals, and their explanation will be omitted.

A difference between a structure as shown in FIG. 2 and the structure as shown in FIG. 1 is that there is provided a projected edge portion 24 in a ring-like shape extending upwardly from an outer circumferential edge of the flange 21 which is provided on the key top 15, and that the projected edge portion 24 is idly inserted into a gap 25 between the large diametered guide wall 13 and the small diametered guide wall 22. Accordingly, at a stroke of the key top 15, the fatty oils of the user's hand which have adhered to the body part 15*a* of the key top 15 will be prevented from falling down by the presence of the flange 21, and at the same time, not only the fatty oils but other foreign substances will be received in a recess 26 which is formed by the projected edge portion 24, and will not directly reach or adhere to the click rubber 16. Thus, the above described advantages can be further promoted.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A key switch, comprising:

a key top, including a body part having a first width and a flange formed on a lower end portion of the body part so as to have a second width that is larger than the first width;

a click rubber, provided on the bottom face of the body part of the key top, the click rubber being elastically deformable such that the top is vertically moved between an upper first position and a lower second position;

a case formed as follows:

with a first chamber having a third width that is larger than the first width but smaller than the second width and includes an interior wall that extends down into the second chamber, for accommodating the body part of the key top therein; and a second chamber continued from the first chamber and having a fourth width that is larger than the second width, for accommodating the flange of the key top and the click rubber therein.

2. The key switch as set forth in claim 1, wherein an upper face of the flange is abutted against the bottom part of the interior wall of the first chamber when the key top is placed in the upper first position.

3. A key, comprising:

a key top, including a body part having a first width and a flange formed on a lower end portion of the body part so as to have a second width that is larger than the first width;

a click rubber, provided on the bottom face of the body part of the key top, the click rubber being elastically deformable such that the top is vertically moved between an upper first position and a lower second position;

a case formed as follows:

with a first chamber having a third width that is larger than the first width but smaller than the second width and includes an interior wall that extends down into the second chamber, for accommodating the body part of the key top therein; and a second chamber continued from the first chamber and having a fourth width that is larger than the second width, for accommodating the flange of the key top and the click rubber therein, wherein:

a recess is formed between the interior wall of the first chamber and the wall of the second chamber;

a protrusion is formed on an upper face of the flange; and the protrusion is fitted into the recess when the key top is placed in the upper first position.

4. A key switch, comprising:

a key top, consisted of a body part having a first width and a flange formed on a lower end portion of the body part so as to have a second width with is larger than the first width;

a click rubber provided on a bottom face of the body part of the key top, the click rubber being elastically deformable such that the key top is vertically moved between an upper first position and a lower second position;

a case formed with a first chamber having a third width which is larger than the first width but smaller than the second width for accommodating the body part of the key top therein, and a second chamber continued from the first chamber and having a fourth width which is larger than the second width for accommodating the flange of the key top and the click rubber therein.

* * * * *